US005601400A

United States Patent [19]

Kondo et al.

[11] Patent Number: 5,601,400

[45] Date of Patent: Feb. 11, 1997

[54] CENTRIFUGAL BLOWER IMPROVED TO REDUCE VIBRATION AND NOISE

[75] Inventors: Yasushi Kondo, Aichi-gun; Koji Ito, Nagoya; Teruhiko Kameoka, Okazaki; Manabu Miyata, Kariya, all of Japan

[73] Assignee: Nippondenso Co., Ltd., Kariya, Japan

[21] Appl. No.: 529,133

[22] Filed: Sep. 15, 1995

[30] Foreign Application Priority Data

Sep. 16, 1994 [JP] Japan ..... 6-221915

[51] Int. Cl.[6] ..... F04D 29/44; F04D 29/66

[52] U.S. Cl. ..... 415/119; 415/206; 415/208.1; 415/211.1

[58] Field of Search ..... 415/119, 206, 415/204, 208.1, 211.1, 183

[56] References Cited

U.S. PATENT DOCUMENTS

| | | | |
|---|---|---|---|
| 3,289,598 | 12/1966 | Buse et al. | 415/211.1 |
| 3,523,743 | 8/1970 | Jolette | 415/204 |
| 3,796,511 | 3/1974 | Hansen | 415/206 X |
| 4,450,755 | 5/1984 | Catan | 415/204 |
| 5,352,089 | 10/1994 | Tokunaga et al. | 415/206 |
| 5,399,068 | 3/1995 | Park | 415/206 |

FOREIGN PATENT DOCUMENTS

| | | | |
|---|---|---|---|
| 59-37300 | 2/1984 | Japan | 415/119 X |
| 3-267600 | 11/1991 | Japan | 415/119 |
| 5306699 | 11/1993 | Japan . | |
| 623006 | 7/1978 | U.S.S.R. | 415/119 X |
| 519630 | 4/1940 | United Kingdom | 415/119 |

*Primary Examiner*—Thomas E. Denion
*Assistant Examiner*—Michael S. Lee
*Attorney, Agent, or Firm*—Cushman, Darby & Cushman IP Group of Pillsbury Madison & Sutro LLP

[57] ABSTRACT

A centrifugal blower is provided with a casing which defines a spiral duct and a centrifugal fan which is rotationally provided within the casing. The centrifugal fan has a bottom plate and a plurality of blades which are equally spaced along the periphery of the bottom plate. The plurality of blades extends parallel to the rotational axis. The duct is arranged to reduce the size of a low velocity air flow zone which is generated in an upper radially outer region in the spiral duct. The low velocity air flow zone, which appears in an upper radially outer region in the air duct, is reduced to reduce surging in the blower.

2 Claims, 11 Drawing Sheets

CENTRIFUGAL BLOWER IMPROVED TO REDUCE VIBRATION AND NOISE

BACKGROUND OF THE INVENTION (1) Field of the Invention

The invention relates to a centrifugal blower; in particular to a centrifugal blower improved to reduce the vibration and noise thereof.

(2) Description of the Related Art

Some centrifugal blowers comprise a motor, a centrifugal fan which is driven by the motor, and a casing, for enclosing the centrifugal fan, which defines a duct in the form of a spiral shape. The shaft of the motor is disposed within the casing and connected to the centrifugal fan.

When the area of the opening of the duct is reduced from fully opened position to fully closed position with the motor rotating constantly, the pressure in the duct changes with relation to the flow rate. In FIG. 14, the change of pressure relative to the flow rate in a centrifugal blower is illustrated. First, the pressure in the duct increases with the increasing flow rate. The increase is the pressure will be saturated at a level of the flow rate, above which the pressure decreases. The surging range is defined as the range in which the pressure increases with the increasing flow rate. In the surging range, pulsation of the pressure, so called "surging", is generated which makes the operation of the blower unstable. In the surging range, the efficiency of the blower is reduced and the vibration and noise in the blower is increased.

An air conditioner for an automobile uses a centrifugal blower which must operate at various flow conditions to adjust the desired flow rate, even in the surge region.

SUMMARY OF THE INVENTION

The objective of the invention is to provide a centrifugal blower which is improved to reduce the vibration and noise over a wide range of operating conditions.

According to the invention, there is provided a centrifugal blower which comprises a casing which defines a spiral duct; a centrifugal fan which is rotationally provided within the casing. The centrifugal fan has a bottom plate and a plurality of blades which are equally spaced along the periphery of the bottom plate. The plurality of blades extends parallel to the rotational axis. The blower further comprises a means for reducing the size of a low velocity air flow zone which is generated in an upper radially outer region in the spiral duct.

In the prior art centrifugal blower, a low velocity air flow zone appears in an upper radially outer region in the air duct. The low velocity air flow zone causes the surging in the centrifugal blower.

According to the invention, the size of the low velocity air flow zone is reduced to reduce the surging in the blower.

According to another feature of the invention, there is provided a centrifugal blower which comprises a casing and a centrifugal fan rotationally provided within the casing. The casing has a top wall which has a spiral periphery, a bottom wall which has a spiral periphery substantially the same as the top wall, and a side wall which extends spirally along the periphery of the top and bottom walls. The side wall connects the top and bottom walls. The centrifugal fan has a bottom plate and a plurality of blades which are equally spaced along the periphery of the bottom plate. The plurality of blades extends parallel to the rotational axis. The blower comprises further a partition wall for separating the air flow in the casing into radially outer flow and radially inner flow. The partition wall is connected to the inner surface of the top wall of the casing.

The partition wall separates the air flow into radially outer and inner flows. Vortex flow, which is generated otherwise between the high and low-velocity zones, is reduced or removed. Thus, surging in the air duct is reduced.

Preferably, the partition wall extends spirally along at least a portion of the top wall of the casing.

In a preferred embodiment, the partition wall extends from the inner surface of the top wall of the casing to a height which is lower than the height of the plurality of blades.

According to another feature of the invention, there is provided a centrifugal blower which comprises a casing and a centrifugal fan rotationally provided within the casing. The casing has a top wall which has a spiral periphery, a bottom wall which has a spiral periphery, a side wall which extends spirally along the periphery of the bottom wall. The side wall is connected to the bottom wall. The casing further comprises an intermediate wall which extends spirally along the periphery of the top and bottom walls. The intermediate wall connects the top and side walls. The centrifugal fan has a bottom plate and a plurality of blades which are equally spaced along the periphery of the bottom plate. The plurality of blades extends parallel to the rotational axis. The casing provides a spiral duct for the air flow and has substantially a rectangular section, perpendicular to the flow direction, which has a cut out portion at the radially outer top corner by the intermediate wall.

The low velocity zone in the air duct is reduced since the area of the air duct is reduced at the radially outer top corner by the intermediate wall. Thus, surging in the air duct is reduced.

In a preferred embodiment of the invention, the intermediate wall is substantially formed into an L shape which has a vertical wall connected to the top wall, and a horizontal wall connected to the vertical wall and to the side wall.

In another embodiment of the invention, the intermediate wall is substantially formed into an outwardly convex or concave wall which is connected to the top wall and to the side wall.

The blower of the invention is preferably adapted to supply and air flow to an air conditioning system in an automobile.

BRIEF DESCRIPTION OF THE DRAWINGS

These and other objects and advantages and, a further description, will now be discussed in conjunction with the drawings in which.

DESCRIPTION OF THE PREFERRED EMBODIMENTS

In the following description, the directions such as "up", "down", "top", "bottom", "vertical" and "horizontal" are defined as those in the respective drawings.

Figure 1:
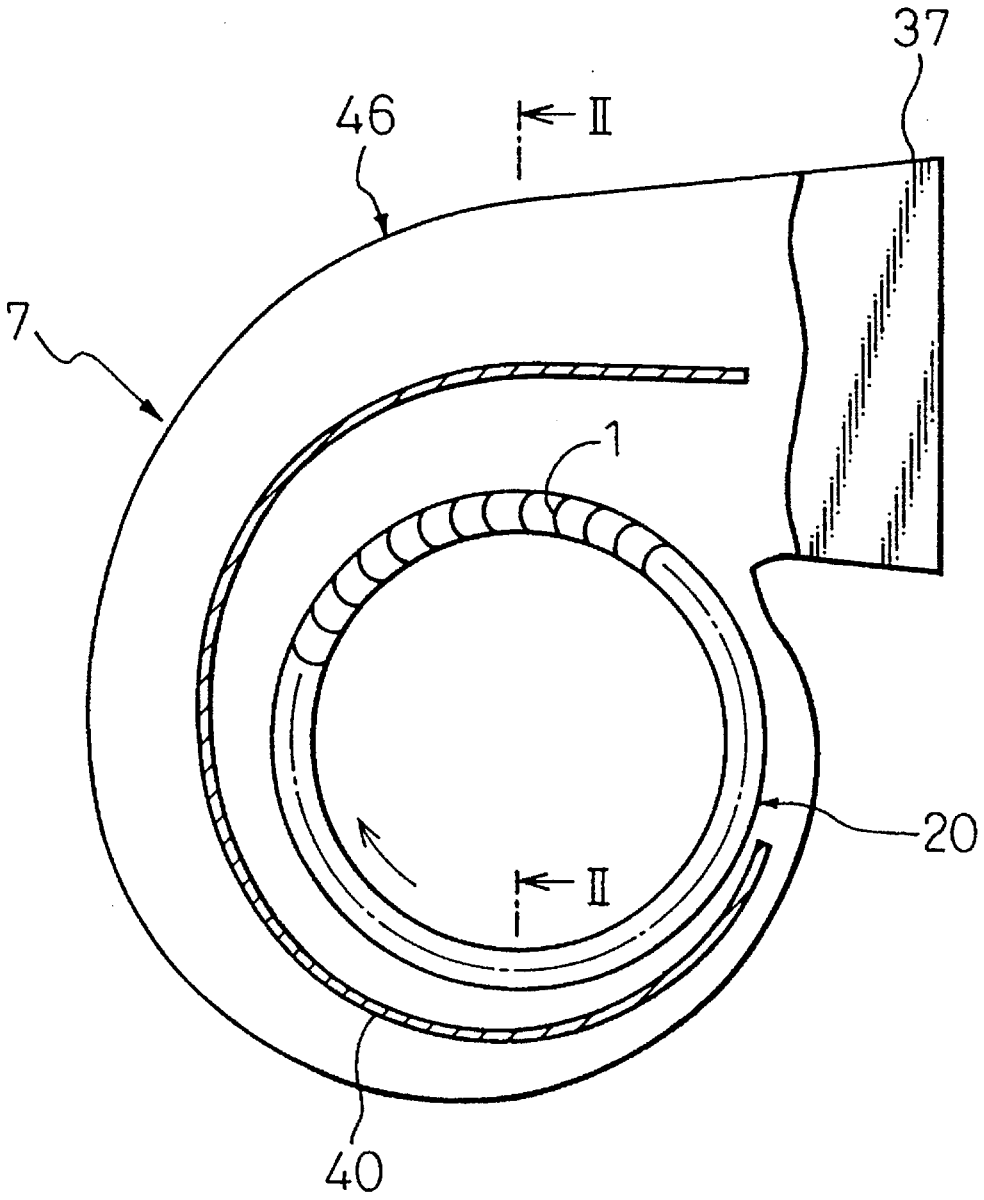
FIG. 1 is a top plan view of a centrifugal blower of the invention in which a portion of the top wall of the casing is removed.
Figure 2:
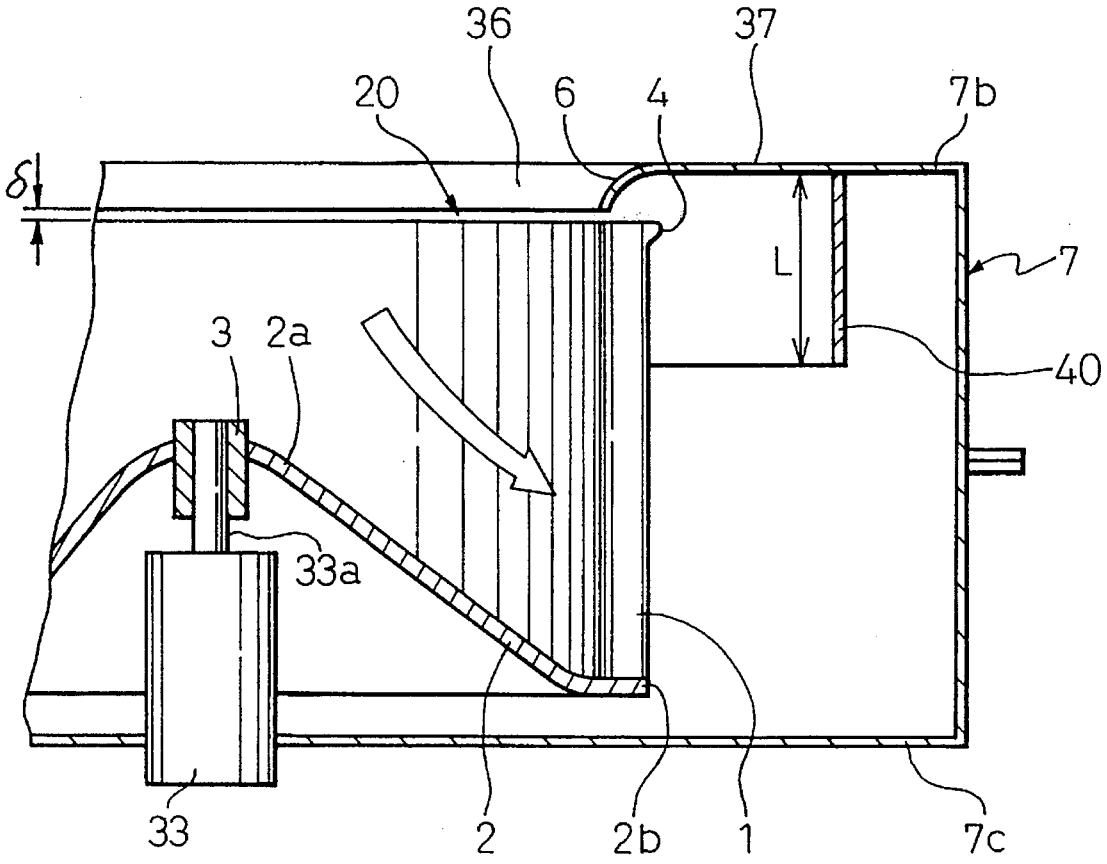
FIG. 2 is a partial section of the centrifugal blower along II—II in FIG. 1.
Figure 3:
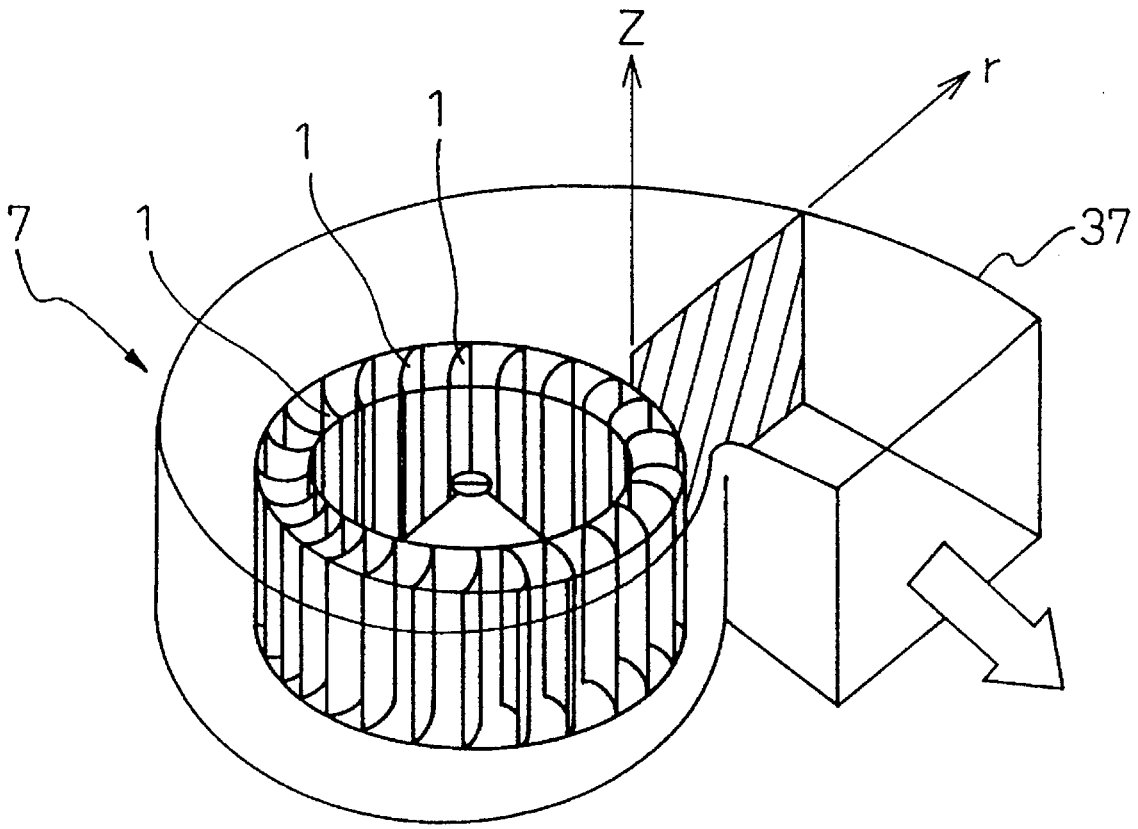
FIG. 3 is a perspective illustration of the centrifugal blower of FIG. 1.

With reference to FIGS. 1 to 3, the preferred embodiment of the invention will be described.

In FIG. 1, a centrifugal blower according to the first embodiment comprises a centrifugal fan 20, and a casing 7 which defines a spiral duct. The casing 7 has a top wall and a bottom wall which have spiral peripheries substantially identical to each other. A side wall extends spirally along the peripheries of the top and bottom walls of the casing. The casing 7 comprises upper and lower casings 7*b* and 7*c* which are connected to each other by a suitable connecting method such as clamps or screws. The casing 7 has a discharge opening 37. An electric motor 33, for driving the centrifugal fan 20, is mounted to the casing 7.

The centrifugal fan 20 comprises a bottom plate 2 and a plurality of blades 1. The bottom plate 2 has a boss 3 which is connected to the shaft 33*a* of the motor 33. The bottom plate 2 protrudes upwardly at the central portion. The blades 1 are equally spaced along the circumference 2*b* of the bottom plate 2 and upwardly extend parallel to the shaft 33*a* of the motor 33. The centrifugal fan further comprises a supporter ring 4 for supporting the tops of the blades 1 to keep the blades 1 vertical.

The upper casing 7*b* has a bell mouth 6 which provides a axial air inlet 36. The bell mouth 6 is arranged so that a gap δ, for example about 3 mm, is provided between the bottom end of the bell mouth 6 and the top of the fan 20.

The inventors have experimentally discovered that a low velocity zone is generated in the radially outer region in the upper casing 7*b*, which results in vibration and noise.

Figure 10:
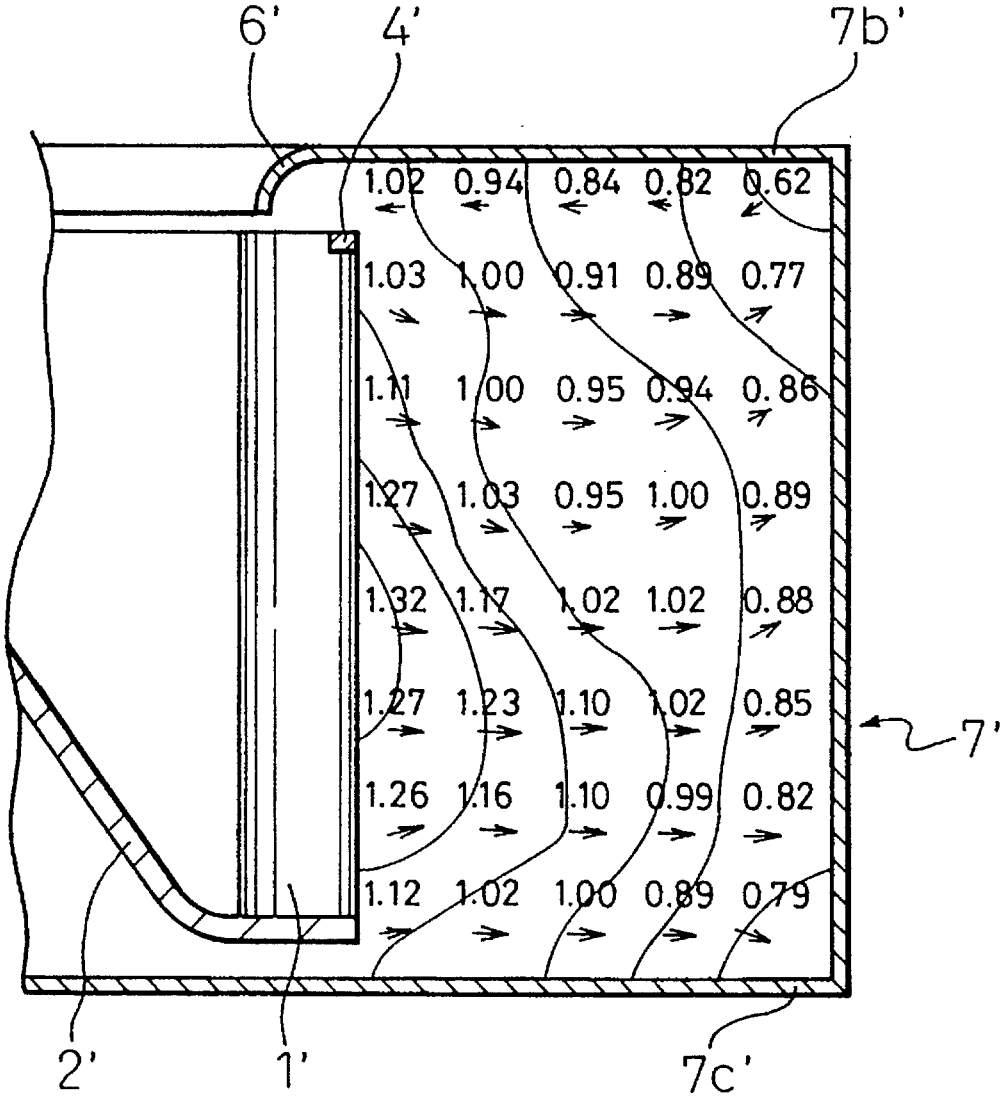
Fig. 10 (PRIOR ART)
FIG. 10 illustrates experimental data of local velocities of the air flow, and pressure, in a duct of a conventional centrifugal blower.
Figure 11:
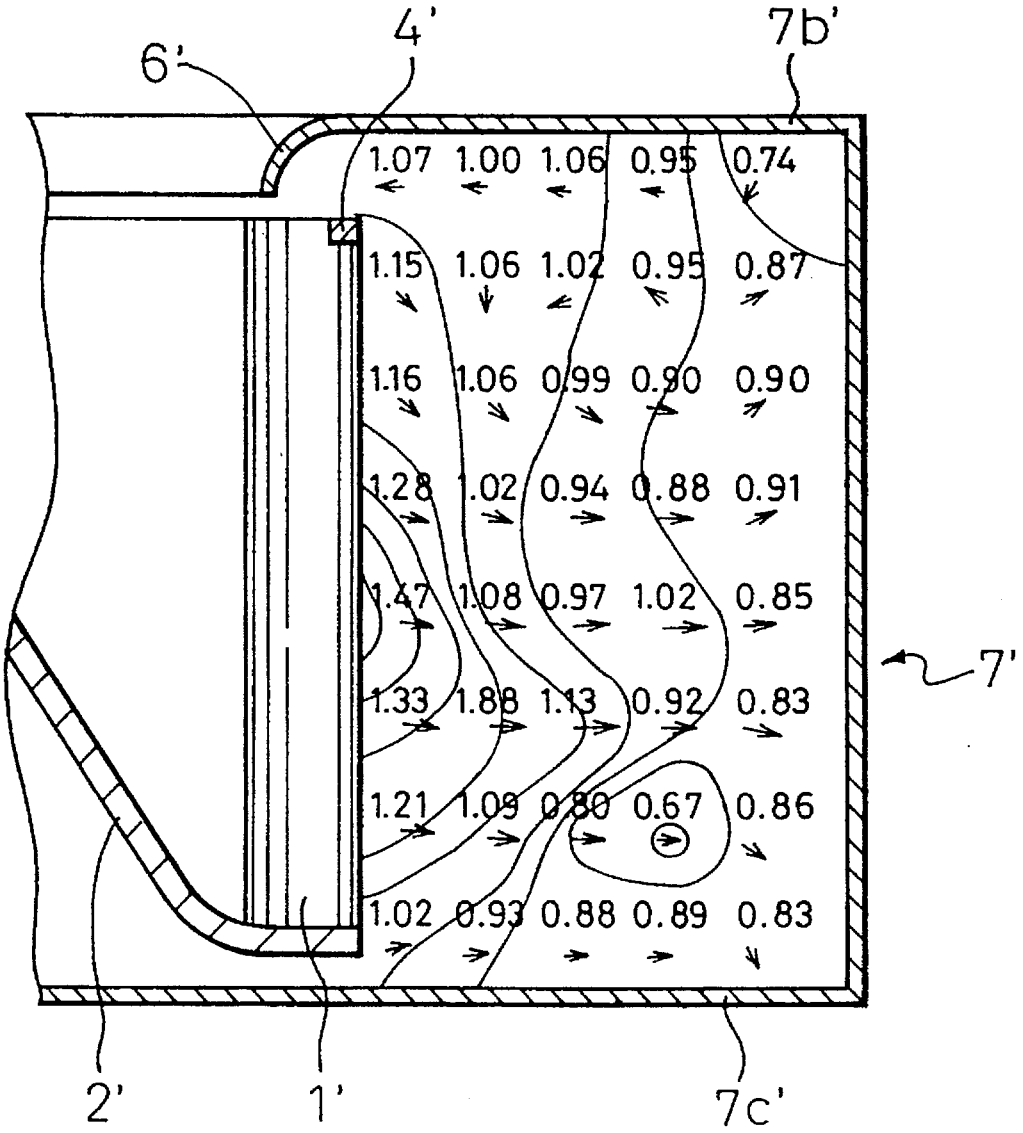
Fig.11 (PRIOR ART)
FIG. 11 is an illustration, similar to FIG. 10, of another conventional centrifugal blower.

With reference to FIGS. 10 and 11, the characteristics of air flow velocity and pressure in two conventional centrifugal blowers A and B are illustrated. The blowers A and B are of the conventional type and substantially the same as in FIG. 2. Thus, the elements similar to those in FIG. 2 are indicated by the same numbers with dash. Each number in FIGS. 10 and 11 is a local velocity of the air flow which is normalized by the mean velocity of the air flow. The curved lines, in FIGS. 10 and 11, are constant-pressure lines.

Referring to FIGS. 10 and 11, it may be understood that, in the blower A (FIG. 10), the local velocities in the radially outer region in the upper casing are lower than those in the blower B. Further the low velocity zone in the blower A is larger than that in the blower B.

Figure 12:
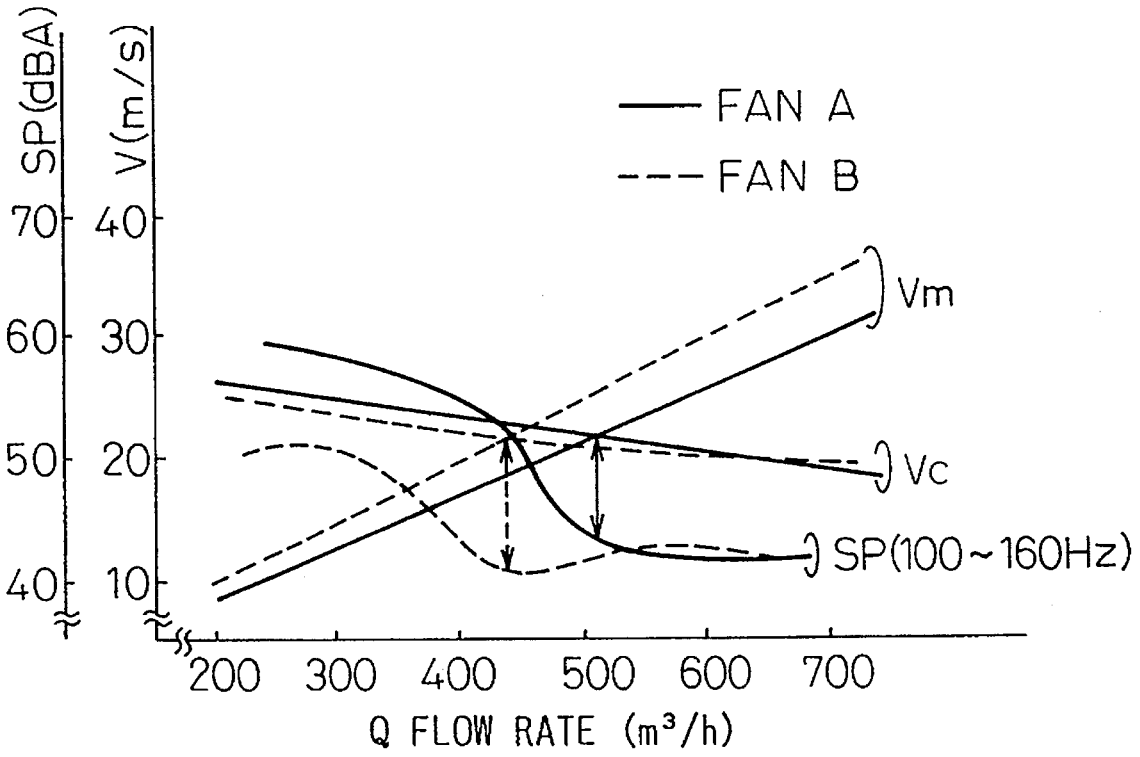
FIG. 12 is an illustration of experimental data of sound pressure level relative to the velocity of the air flow in the blowers of FIGS. 10 and 11.
Figure 13:
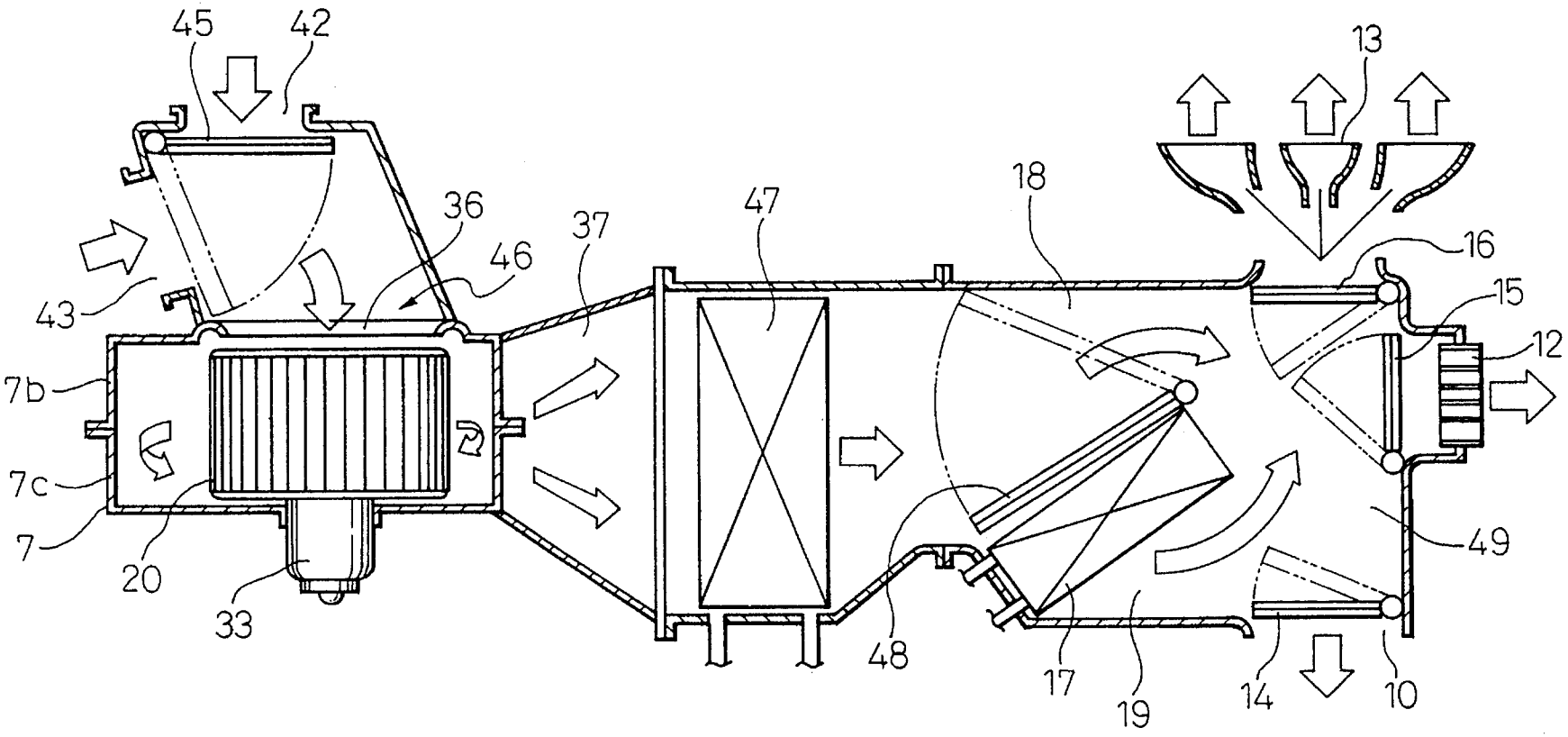
FIG. 13 is a side section of an air conditioning system to which the inventive centrifugal blower can be applied.

With reference to FIG. 12, experimental data of sound pressure levels relative to the air flow velocity in the centrifugal blowers A and B are illustrated. In FIG. 12, the horizontal line is the flow rate, and the vertical lines are sound pressure level and velocity. In FIG. 12, "Vm" indicates the mean velocity of the air flow, "Vc" indicates the circumferential velocity of the fan, and "SP" indicates the sound pressure level. The sound pressure level was measured within the frequency range of 100–160 Hz.

It may be understood that, in case of both the blowers A and B, the sound pressure levels are relatively high within a range in which the circumferential velocity Vc of the fan exceeds the mean velocity Vm of the air flow. Further, in the blower A, the high sound pressure range is wider than that in the blower B. It may assumed that the large low velocity zone in the blower A makes the high sound pressure range wide. Thus, if the low velocity zone is separated or removed, the sound pressure level is reduced.

Referring to FIGS. 1 to 3 again, a partition plate 40, which has width L, is provided on the inner surface of the top wall of the upper casing 7*b*. The partition wall 40 partially divides the duct, which is defined by the casing 7, into radially inner and outer portions. The partition plate 40 spirally extends along at least a portion of the inner surface of the top wall of the casing 7. In the upper casing 7*b*, the low velocity air flow results in a vortex flow generated between the low velocity zone and the high velocity zone. The partition plate 40 separates the radially outer region from the inner region to prevent the generation of the vortex flow in the upper casing 7*b*. Thus, the vibration and noise of the blower is reduced.

Figure 4:
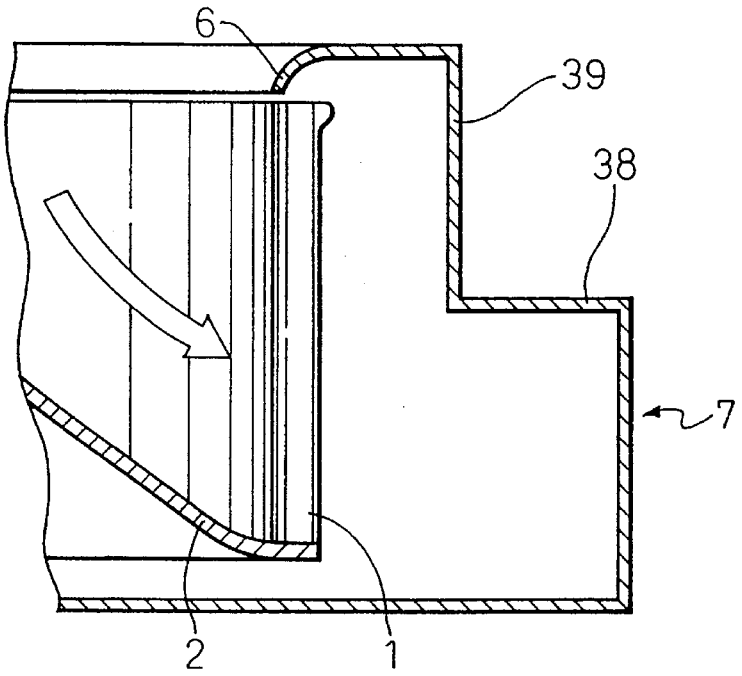
FIG. 4 is an partial section, similar to FIG. 2, of the centrifugal blower according to another embodiment of the invention.

With reference to FIG. 4, another embodiment of the invention will be described. In the drawing and the following description, the elements similar to those of the first embodiment are indicated by the same reference numbers.

In this embodiment, the casing 7 is formed into a stepped spiral duct. The casing 7 comprises upper and lower casings 7*b* and 7*c* which are connected to each other by a suitable connecting manner such as clamps or screws. The casing 7 has a discharge opening 37. An electric motor 33, for driving the centrifugal fan 20, is mounted to the casing 7.

The casing 7 has a top and bottom walls. The top wall has a spiral periphery. The bottom wall has a spiral periphery which is larger than that of the top wall. A side wall extends spirally along the periphery of the bottom wall of the casing. An intermediate wall is provided to connect the side wall and the top wall.

As shown in FIG. 4, the radially outer region in the upper casing 7*b* is removed from the casing 7 by the intermediate wall which comprises vertical and horizontal walls 39 and 38. The vertical wall 39 is arranged parallel to the shaft 33*a* of the motor 33 and spirally extends along the spiral periphery of the top wall of the casing 7. The horizontal wall 38 is arranged perpendicular to the first wall and connects the vertical wall to the side wall.

Figure 5:
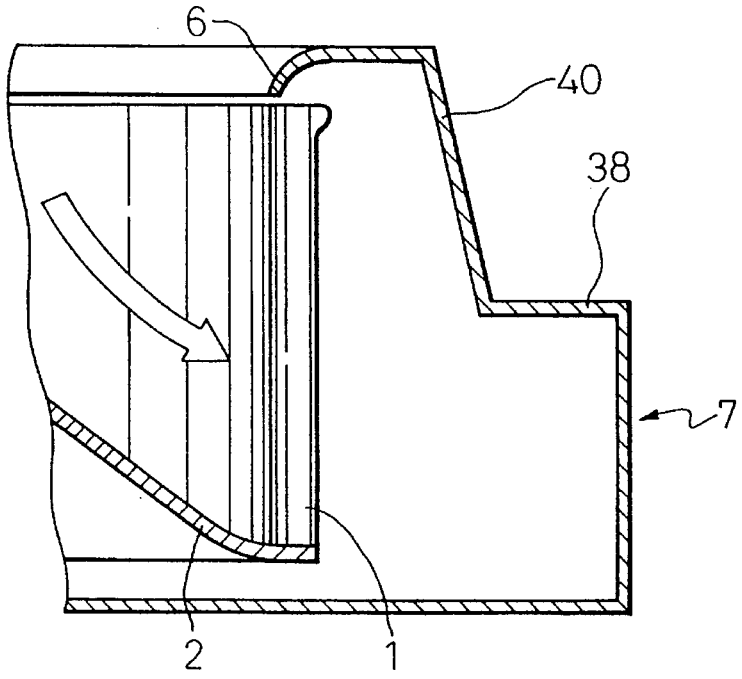
FIG. 5 is an partial section, similar to FIG. 2, of the centrifugal blower according to another embodiment of the invention.

With reference to FIG. 5, another embodiment of the invention will be described. In the drawing and the following description, the elements similar to those of the first embodiment are indicated by the same reference numbers.

In this embodiment, the casing 7 is formed in to a stepped spiral duct as in the second embodiment. As shown in FIG. 5, the radially outer region in the upper casing 7*b* is removed from the casing 7 by the intermediate wall which comprises vertical and horizontal walls 40 and 38. The vertical wall 38 is inclined to the shaft 33*a* of the motor 33 and spirally extends along the spiral periphery of the top wall of the casing 7. The horizontal wall 38 is arranged perpendicular to the shaft 33*a* of the motor 33 and spirally extends along the casing 7.

Figure 6:
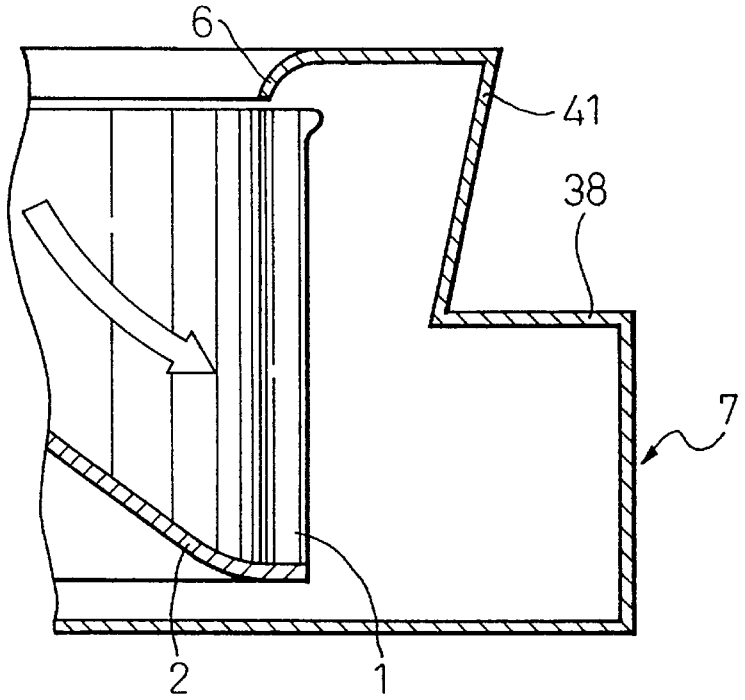
FIG. 6 is an partial section, similar to FIG. 2, of the centrifugal blower according to another embodiment of the invention.
Figure 7:
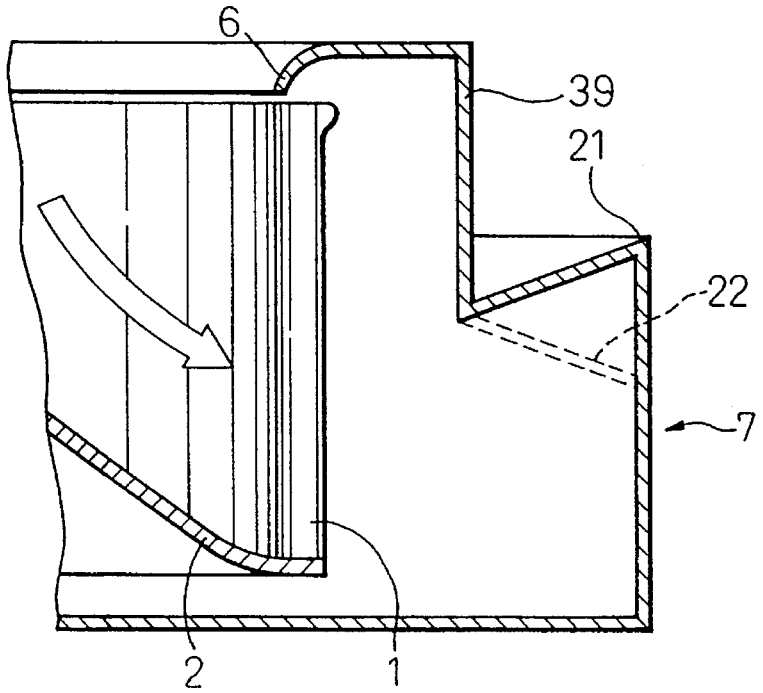
FIG. 7 is an partial section, similar to FIG. 2, of the centrifugal blower according to another embodiment of the invention.

The vertical wall can be inclined by the opposite angle as shown by the vertical wall 41 in FIG. 6. Further, the horizontal wall can be inclined as shown by the inclined horizontal walls 21 and 22 in FIG. 7.

Figure 8:
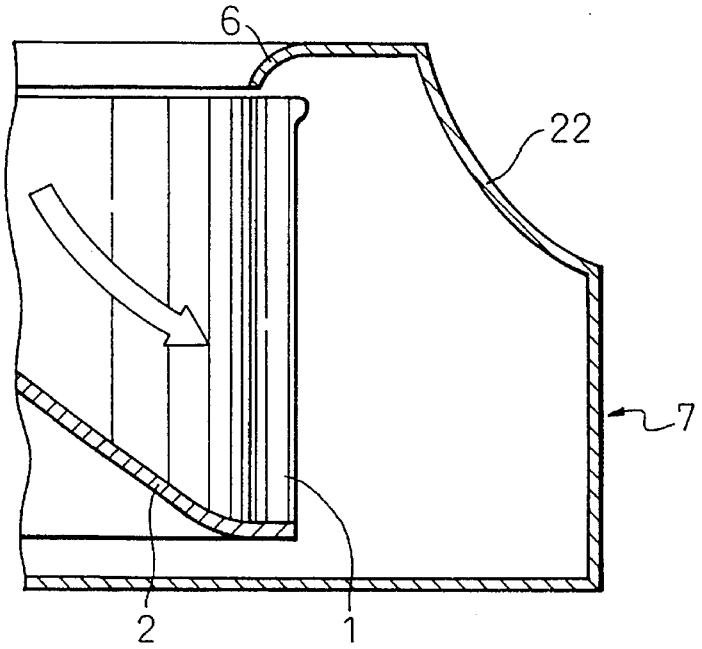
FIG. 8 is an partial section, similar to FIG. 2, of the centrifugal blower according to another embodiment of the invention.

With reference to FIGS. 8, another embodiment of the invention will be described. In the drawing and the following description, the elements similar to those of the first embodiment are indicated by the same reference numbers.

Figure 9:
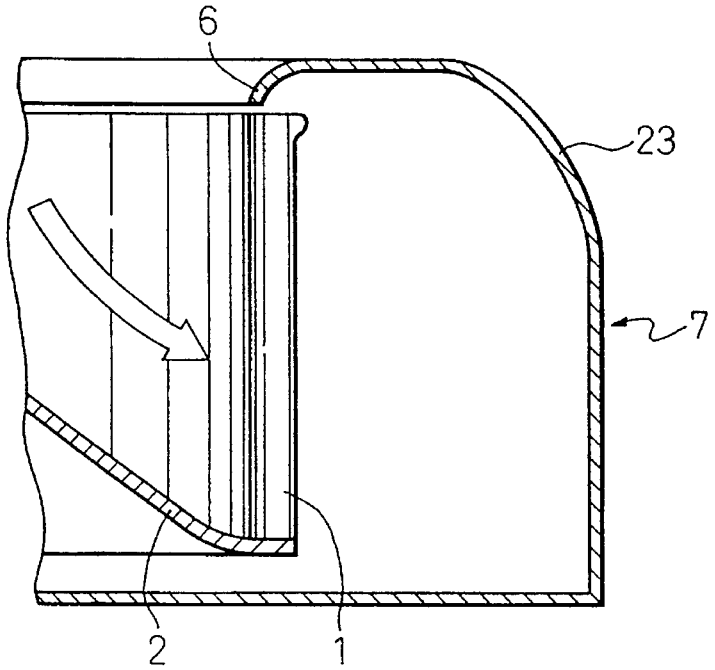
FIG. 9 is an partial section, similar to FIG. 2, of the centrifugal blower according to another embodiment of the invention.

In this embodiment, the radially outer corner in the upper casing 7*a* is removed by the curved wall 22 as shown in FIG. 8. The curved wall 22 is formed into an outwardly concave shape and extends along the casing 7. The curved wall may be formed into an outwardly convex shape as shown in FIG. 9.

In the embodiments described with reference to FIGS. 3 to 9, the radially outer regions in the upper casing 7*a*, in which the air flow velocity is low, are removed to reduce the vibration and noise.

Figure 14:
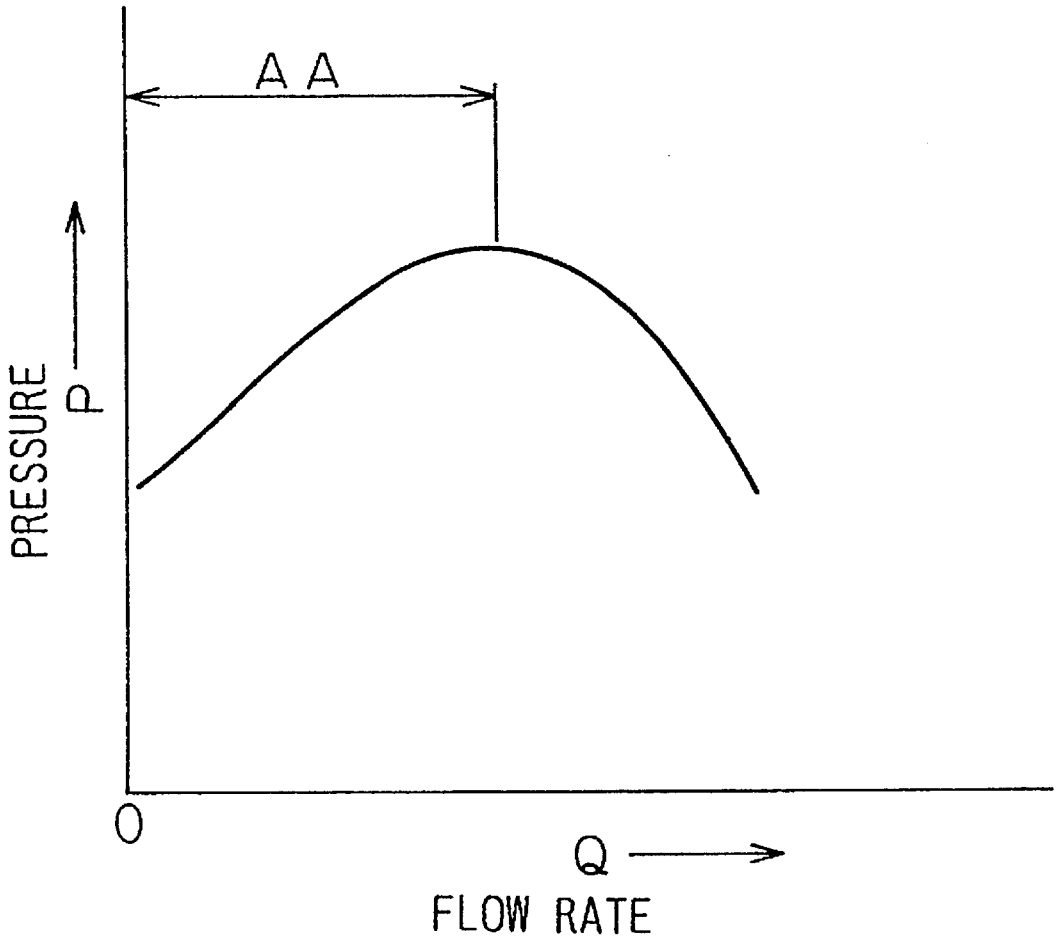
FIG. 14 is an illustration of experimental data of pressure, in the duct of a conventional centrifugal blower, relative to the flow rate.

With reference to FIG. 14, there is shown an air conditioning system for an automobile to which system the centrifugal blower of the invention is applied.

The air conditioning system comprises the blower 46, a connection duct 37 and a main duct 50. Air is introduced into the blower 46 through first and second inlets 42 and 43. The first inlet 42 is provided to introduce the air from the exterior of the automobile. An air filter 45 is provided to the first inlet 42. The second inlet 43 is provided to introduce the air from the interior of the automobile. The air through the first and second inlets 42 and 43 is introduced into the blower 46 through the air inlet 36 of the blower 46.

The air is introduced to the main duct 50 from the blower 46 through the connecting duct 37. An evaporator 47 is provided in the main duct 50 adjacent to the inlet of the main duct 50. A air mix damper 48 is provided downstream of the evaporator 47. The air mix damper 48 separates the main duct 50 into first and second ducts 18 and 19. In the second duct 19, a heater core 17 is provided. The air flows through the first and second ducts 18 and 19 are mixed in an air mix chamber 49. The mixed air is discharged into the compartment of the automobile through air outlets 10, 12 and 13. The air outlets 10, 12 and 13 are positioned suitably in the compartment of the automobile. Dampers 14, 15 and 16 are provided advantageously at the respective air outlets 10, 12 and 13. The air is discharged into the compartment after the temperature and humidity is adjusted by the evaporator 47 and the heater core 17.

It is further understood by those skilled in the art that the forgoing description is a preferred embodiment of the disclosed device and that various changes and modifications may be made without departing from the spirit and scope of the invention.

We claim:

1. A centrifugal blower comprising:

a casing having a top wall which has a spiral periphery, a bottom wall which has a spiral periphery, a side wall spirally extending along the periphery of the bottom wall, the side wall being connected to the bottom wall, and an intermediate wall spirally extending along the periphery of the top wall, the intermediate wall connecting the top and side walls and the intermediate wall substantially forming an L shape which has a substantially vertical wall connected to the top wall, and a substantially horizontal wall connected to the vertical wall and to the side wall;

a centrifugal fan rotationally provided within the casing, the centrifugal fan having a bottom plate and a plurality of blades separated along the periphery of the bottom plate, the plurality of blades extending substantially parallel to the rotational axis; and the casing providing a spiral duct for the air flow, the duct having a substantially rectangular section, perpendicular to the flow direction, which has a cut out portion at the radially outer top corner by the intermediate wall.

2. A centrifugal blower comprising:

a casing having a top wall which has a spiral periphery, a bottom wall which has a spiral periphery, a side wall spirally extending along the periphery of the bottom wall, the side wall being connected to the bottom wall, and an intermediate wall spirally extending along the periphery of the top wall, the intermediate wall connecting the top and side walls and the intermediate wall substantially forming an outwardly concave wall which is connected to the top wall and to the side wall;

a centrifugal fan rotationally provided within the casing, the centrifugal fan having a bottom plate and a plurality of blades separated along the periphery of the bottom plate, the plurality of blades extending substantially parallel to the rotational axis; and the casing providing a spiral duct for the air flow, the duct having a substantially rectangular section, perpendicular to the flow direction, which has a cut out portion at the radially outer top corner by the intermediate wall.

* * * * *